US007165886B2

(12) United States Patent
Linton et al.

(10) Patent No.: US 7,165,886 B2
(45) Date of Patent: Jan. 23, 2007

(54) TOP-FILL RECLOSABLE BAG HAVING WICKET FLAP AND RELATED METHOD OF MANUFACTURE

(75) Inventors: Basil C. Linton, Loganville, GA (US); Gregory H. Crunkleton, Nicolson, GA (US); Jorge Lustgarten Laufer, Caracas (VE)

(73) Assignee: Illinois Tool Works Inc., Glenview, IL (US)

( * ) Notice: Subject to any disclaimer, the term of this patent is extended or adjusted under 35 U.S.C. 154(b) by 536 days.

(21) Appl. No.: 10/702,229

(22) Filed: Nov. 6, 2003

(65) Prior Publication Data

US 2004/0161173 A1 Aug. 19, 2004

Related U.S. Application Data

(63) Continuation-in-part of application No. 10/610,805, filed on Jul. 1, 2003, now Pat. No. 7,036,987, which is a continuation-in-part of application No. 10/367,450, filed on Feb. 14, 2003, now Pat. No. 6,951,421.

(51) Int. Cl.
*B65D 33/16* (2006.01)
*B65D 33/10* (2006.01)

(52) U.S. Cl. ..... 383/64; 383/9

(58) Field of Classification Search ..... 383/64, 383/9

See application file for complete search history.

(56) References Cited

U.S. PATENT DOCUMENTS

| | | | | |
|---|---|---|---|---|
| 5,100,000 | A | 3/1992 | Huseman | |
| 5,682,730 | A | 11/1997 | Dobreski | |
| 6,361,209 | B1 * | 3/2002 | LaRue et al. | 383/10 |
| 6,536,951 | B1 * | 3/2003 | Sill | 383/9 |
| 7,036,987 | B1 * | 5/2006 | Crunkleton et al. | 383/64 |
| 2002/0015537 | A1 | 2/2002 | Koibe et al. | |
| 2003/0202717 | A1 * | 10/2003 | Schneider et al. | 383/5 |
| 2005/0135710 | A1 * | 6/2005 | Melchoir | 383/63 |

FOREIGN PATENT DOCUMENTS

WO WO 03/082691 A 10/2003

* cited by examiner

*Primary Examiner*—Jes F. Pascua
(74) *Attorney, Agent, or Firm*—Ostrager, Chong, Flaherty, & Broitman P.C.

(57) ABSTRACT

A reclosable bag having a top flap with holes configured to allow a stack of such bags to be mounted on a wicket or a pair of dispensing posts, and having a slider-actuated zipper (e.g., a string zipper) installed in a mouth at the top of the bag. The wicket flap is suspended between two zones of attachment generally located at opposite ends of the mouth of the bag. In one embodiment, the flap is attached to the slider end stops stomped in opposing ends of the zipper.

19 Claims, 6 Drawing Sheets

TOP-FILL RECLOSABLE BAG HAVING WICKET FLAP AND RELATED METHOD OF MANUFACTURE

RELATED PATENT APPLICATION

This application is a continuation-in-part of and claims priority from U.S. patent application Ser. No. 10/610,805 filed on Jul. 1, 2003 and entitled "Reclosable Bag Having Wicket Flap Slider-Actuated String Zipper", now U.S. Pat. No. 7,036,987, which is a continuation-in-part of U.S. patent application Ser. No. 10/367,450 filed on Feb. 14, 2003, now U.S. Pat. No. 6,951,421.

BACKGROUND OF THE INVENTION

This invention generally relates to reclosable bags having slider-actuated zippers. In particular, the invention relates to slider-actuated reclosable bags having a header or flap with holes or slits for mounting a stack of unfilled bags on a wicket.

Reclosable bags are finding ever-growing acceptance as primary packaging, particularly as packaging for foodstuffs such as cereal, fresh fruit and vegetables, snacks and the like. Such bags provide the consumer with the ability to readily store, in a closed, if not sealed, package any unused portion of the packaged product even after the package is initially opened.

Reclosable bags generally comprise a receptacle having a mouth with a plastic zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

In a specific application, reclosable bags are commonly used by deli clerks in grocery stores to package cheese and deli meats sold to consumers. To facilitate handling of the reclosable bags by the deli clerks, the bags often include a header having one or more holes for mounting a stack of bags to one or more dispensing posts. The reclosable bags are typically mounted to the dispensing posts in bag packs consisting of a predetermined number of bags. The dispensing posts may, e.g., take the form of a U-shaped wicket wherein the legs of the U-shaped wicket penetrate respective holes formed in the header of each bag. The header may take the form of a top header extending upward from the zippered mouth of the bag or a bottom header extending downward from the bottom of the bag. Stacks of such bags are also used to pack grapes.

U.S. Pat. No. 5,682,730 discloses a plurality of plastic bags formed into unitary packs for shipping and loading onto dispensing posts. This is done by stacking the bags and then assembling them into a unitary pack by penetrating the stack with a heated or ultrasonic pin or punch element to form apertures. The bags in the pack are heat-welded or ultrasonically welded together along the periphery of the apertures. To maintain the integrity of the bag pack during shipping, the bag is mounted to dispensing posts in the form of a wicket prior to shipment.

More specifically, U.S. Pat. No. 5,682,730 discloses a reclosable bag having a bottom header with two holes for mounting the plastic bag to a pair of dispensing posts. The holes are spaced apart along a lateral line running generally parallel to the zipper. The bottom header includes a line of perforations that allows the bag to be tom away from the header after the bag has been filled with product. The embodiment illustrated in U.S. Pat. No. 5,682,730 has a bottom header that includes a pair of opposing header panels connected by a fold. The fold forms a primary bottom, while a seal line of thermal fusion forms a secondary bottom at the junction of the receptacle and the header. This patent further states that one of the header panels can be eliminated. The top of the bag U.S. Pat. No. 5,682,730 has a slider-actuated zipper. The zipper comprises two profiled zipper parts that have respective fins or flanges thermally fused to the inner surfaces of the receptacle panels.

An alternative to the aforementioned flanged zipper design is the so-called flangeless or string zipper, which has substantially no flange portions above or below the interlockable zipper strips. In the case of a string zipper, the bag making film is joined to the backs of the bases of the zipper strips. String zippers can be produced at much greater speeds, allow much greater footage to be wound on a spool, thereby requiring less set-up time, and use less material than flanged zippers, enabling a substantial reduction in the cost of manufacture and processing.

U.S. patent application Ser. No. 10/367,450 discloses a reclosable bag in which respective marginal portions of the bag film are sealed to the back sides of respective flangeless zipper strips and in which the resulting string zipper is actuated by means of a slider.

There is a continuing need for new designs of wicketed reclosable bags that can be manufactured at low cost. In particular, there is a need for a low-cost method of manufacturing a reclosable bag having a top header with holes or slits for hanging the bag on a wicket or on dispensing posts.

BRIEF DESCRIPTION OF THE INVENTION

The present invention is directed, in part, to a reclosable bag having a top flap with holes configured to allow a stack of such bags to be mounted on a wicket or a pair of dispensing posts and, in part to a method of manufacturing such a reclosable bag.

One aspect of the invention is a reclosable bag comprising a receptacle having a mouth, a string zipper joined to the receptacle at the mouth, the string zipper comprising first and second mutually interlockable zipper parts, a slider mounted to the string zipper to cause the first and second zipper parts to separate when the slider is moved in one direction along the string zipper and to cause the first and second zipper parts to interlock when the slider is moved in an opposite direction along the string zipper, and a header panel that is suspended between two zones of attachment generally located at opposite ends of the mouth.

Another aspect of the invention is a reclosable bag comprising: a zipper comprising first and second zipper strips, the first zipper strip comprising a first base and a first closure profile projecting from the first base, and the second zipper strip comprising a second base and a second closure profile projecting from the second base and engageable with the first closure profile; a receptacle comprising first and second walls, the first wall comprising a marginal portion joined to the first base of the first zipper strip, and the second wall comprising a marginal portion joined to the second base of the second zipper strip; a slider mounted on the zipper and movable in opposite directions for opening and closing the zipper; and a flap comprising first and second portions joined to different portions of the joined second wall and second base, and a third portion not joined to the joined second wall and second base, the third portion being disposed between the first and second portions and including a portion disposed adjacent the slider.

A further aspect of the invention is a method of manufacture comprising the following steps: (a) folding a web of bag making film so that a first portion of the web on one side of the fold has an extension portion that extends beyond an edge of a second portion of the folded web; (b) joining a back of a first flangeless zipper strip to the first web portion along a first zone of joinder before or after the folding step, the first zone of joinder being proximate to, but not on the extension portion; (c) joining a back of a second flangeless zipper strip to the second web portion along a second zone of joinder before or after the folding step, the second zone of joinder being proximate to the edge; (d) aligning the first flangeless zipper strip with the second flangeless zipper strip; (e) removing the extension portion of the web; (f) inserting sliders at spaced intervals along the aligned first and second flangeless zipper strips; and (g) attaching the extension portion at regular intervals along one of the first and second zones of joinder to form respective zones of attachment.

Yet another aspect of the invention is a method of manufacturing a reclosable bag, comprising the following steps: (a) arranging and sealing film material to form a receptacle, the receptacle having an interior volume and a mouth for accessing the interior volume; (b) prior to completion of the receptacle, joining opposing portions of the film material, that will form the mouth of the receptacle, to respective backs of first and second flangeless zipper strips, thereby forming first and second zones of joinder; (c) aligning the first and second flangeless zipper strips with each other; (d) after steps (b) and (c), mounting a slider onto the aligned first and second flangeless zipper strips; and (e) attaching first and second portions of a strip of film material at first and second locations along the first zone of joinder, the attached portions being disposed along one edge of the strip with spacing therebetween, and the slider being located between the attached portions of the strip of film material.

A further aspect of the invention is a reclosable bag comprising a receptacle having a mouth, first and second zipper strips installed in the mouth, the first and second zipper strips being fused at opposing ends thereof to form first and second slider end stops and being mutually interlockable between the first and second slider end stops, a slider mounted to the first and second zipper strips and selectively movable between the first and second slider end stops to cause the first and second zipper strips to separate or interlock, and a header panel comprising a first portion attached to the first slider end stop, a second portion attached to the second slider end stop, and a free third portion extending between the attached first and second portions and disposed adjacent the first zipper strip, wherein the third portion of the header panel does not interfere with movement of the slider.

Yet another aspect of the invention is an apparatus comprising: knife arranged to continuously sever a strip of film material from a web of film material along a line adjacent and parallel to a zipper strip of a zipper joined to the web each time the web is advanced; a slider insertion device for inserting successive sliders on the zipper at spaced intervals therealong after each advance of the web, the slider insertion device being located downstream of the knife; an ultrasonic welding device for deforming the zipper at spaced intervals therealong, the ultrasonic welding device being located downstream of the slider insertion device and comprising an ultrasonic transducer; and means for guiding the severed strip of material from the knife to a position whereat a portion of the strip is disposed between the ultrasonic transducer and the zipper without the strip interfering with operation of the slider insertion device, the strip portion being fused to the zipper by the ultrasonic welding device when the zipper is deformed.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
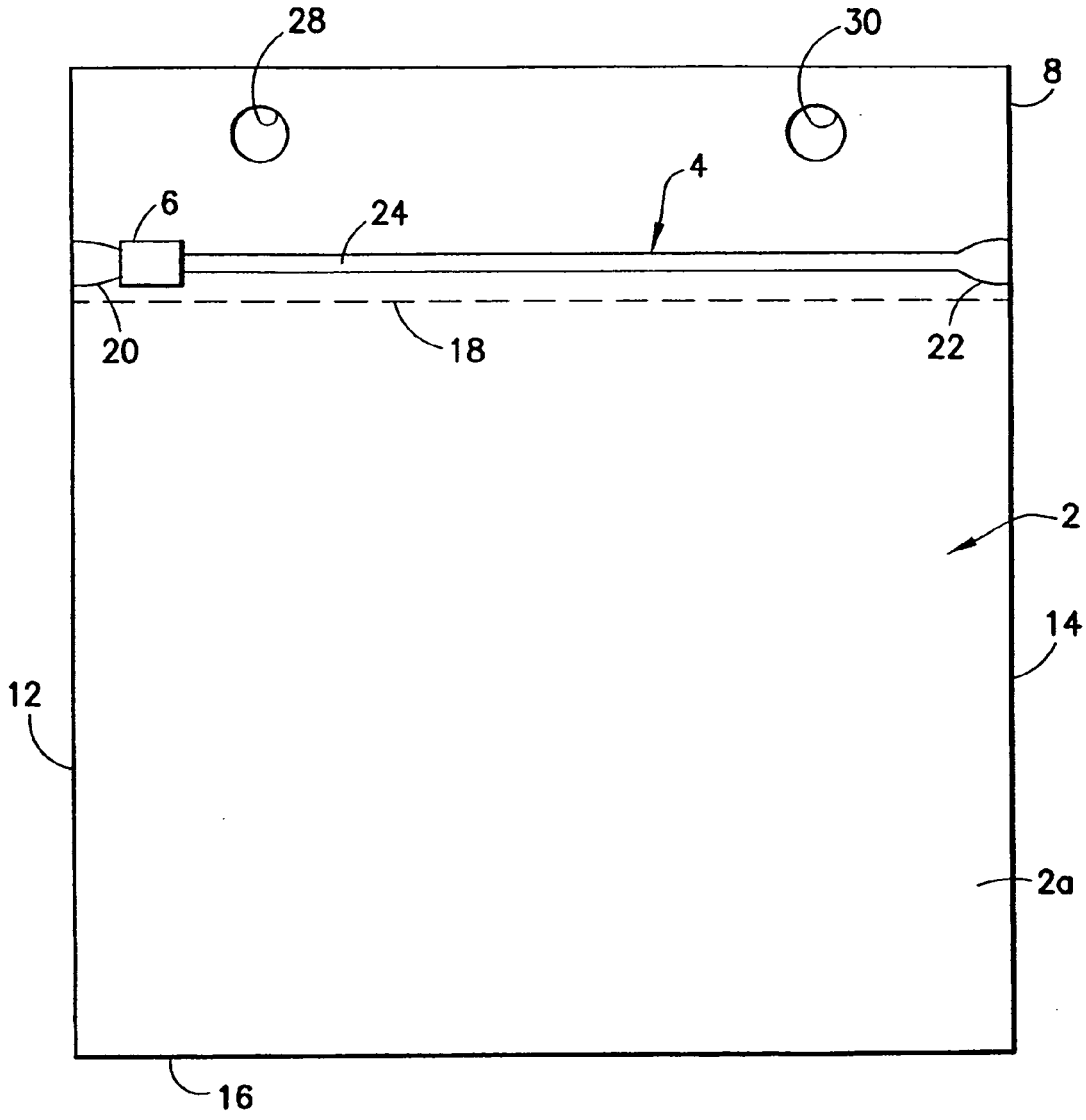
FIG. 1 is a drawing showing a front view of a wicketed reclosable bag in accordance with one embodiment of the present invention. For the purpose of this illustration, it has been assumed that the bag film is optically transparent, so that the zipper is visible behind a layer of film.

A reclosable bag in accordance with one embodiment of the invention is shown in FIG. 1. The bag comprises a receptacle 2 made of a bag making film. The receptacle 2 has a mouth at the top in which a string zipper is installed. The receptacle is closed along a bottom 16 and two sides 12 and 14. More specifically, the receptacle 2 comprises front and rear walls (2*a* and 2*b* in FIG. 2) joined at the bottom 16 by a fold and at the sides 12 and 14 by respective heat seals. The string zipper 4 comprises a pair of interlocked zipper strips (only zipper strip 24 is visible in FIG. 1, with the other zipper strip being disposed behind the zipper strip 24) joined at their ends by respective seals 20 and 22 (formed, e.g., by application of heat and pressure or ultrasonic wave energy). String zipper 4 is actuated by a slider 6. The string zipper 4 is opened when the slider 6 is moved in one direction and closed when the slider 6 is moved in the opposite direction. The end stops 20 and 22 prevent the slider from sliding off the end of the zipper when the slider reaches the zipper closed or fully opened position.

The bag depicted in FIG. 1 further comprises a header panel or wicket flap 8 that is attached to the rest of the bag at only two places, namely, in the vicinities of the slider end stops 20 and 22. The portion of the flap extending between these zones of attachment is not attached to the rest of the bag. The flap 8 is a rectangular piece of film material having a bottom edge that is indicated by dashed line 18 in FIG. 1. The line is dashed to represent that the marginal portion of flap 8 adjacent edge 18 is disposed behind the top of the receptacle and behind the string zipper 4. The flap 8 has a length equal to the width of the receptacle 2. In addition, the flap 8 has a pair of circular holes 28 and 30 that are spaced apart along a line running generally parallel to the zipper. These holes are used to mount each bag on a pair of posts or wicket legs (not shown in FIG. 1) to form a stack. Slits can be used instead of holes.

In a prototype bag, the flap is attached to the slider end stops and the portions of the side edges of the flap that extend below the slider end stops are joined to the confronting sealed portions of the side edges of the front and rear receptacle walls. The three side edges are joined together during cross cutting with a hot knife to form the side seals and sever the bag from zipper-web assembly in process. Alternatively, the flap could be attached to the rest of the bag by sealing to the slider end stops only. However, it should be appreciated that the broad scope of the invention encompasses attaching the flap to one wall of the receptacle in respective areas below the slider end stops. The zones of attachment should be located on opposite sides of the bag and sized so that the attached portions of the flap do not interfere with travel of the slider along the zipper.

Figure 3:
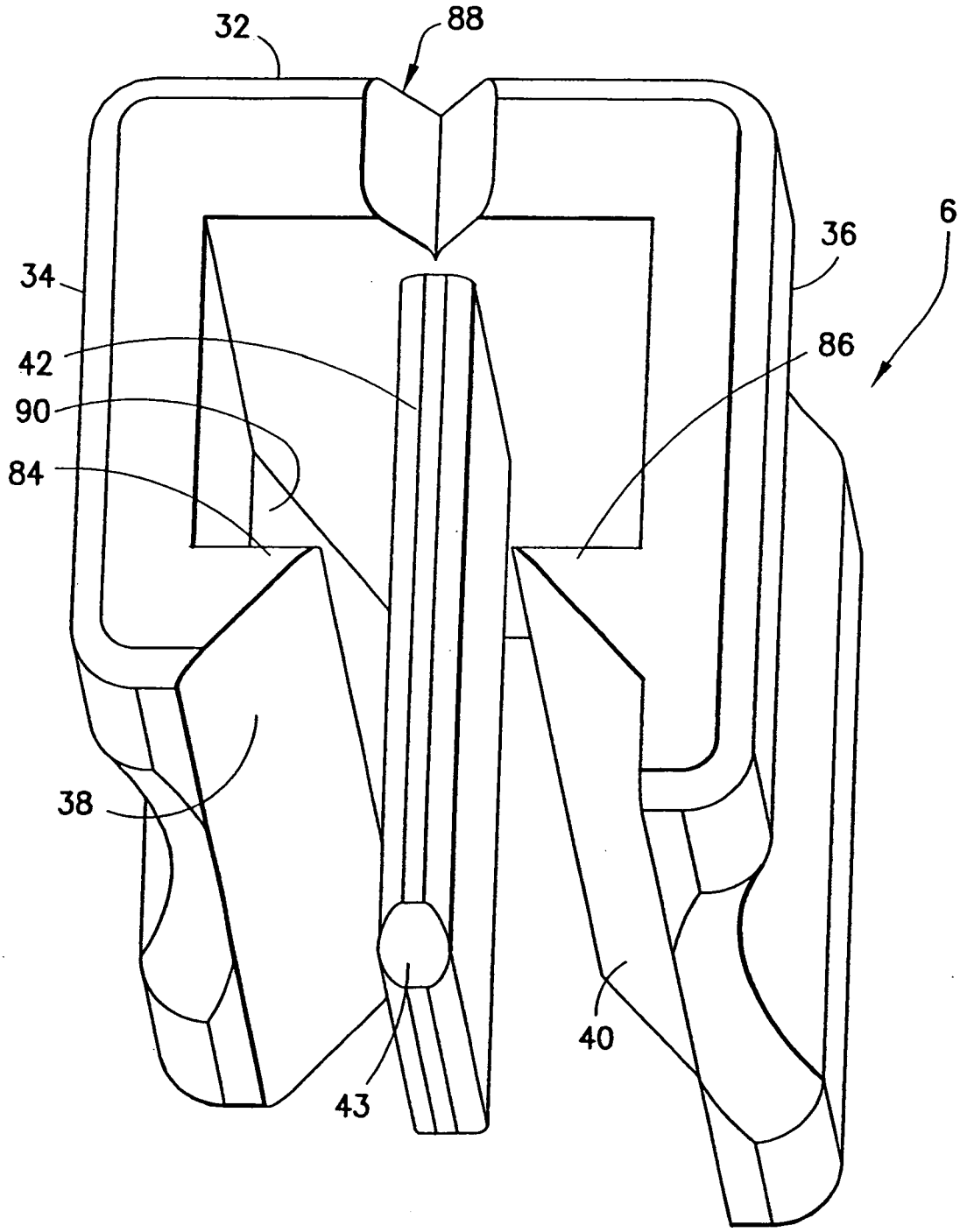
FIG. 3 is a drawing showing an isometric view of one type of slider that can be incorporated in the assembly depicted in FIG. 2.

Wicketed bags are typically manufactured on a machine. At the end of the production line, each finished bag is delivered to a pair of pickup arms, which are passed through the respective openings in the wicket flap. A predetermined number of bags are placed on the arms to form a stack. When a pair of pickup arms is filled with bags, that stack is replaced by another set of pickup arms having no bags stacked thereon. Each completed stack of bags is later lifted manually or automatically off of the pickup arms and while the holes are still aligned, the parallel legs of a U-shaped wicket made of wire are passed through the holes. The stack of bags is secured on the wicket and then placed inside a box for shipment, e.g., to a grocery store. In use, the bags are filled with product manually, as depicted in FIG. 3 of U.S. Pat. No. 5,682,730. Then the open top of the bag is closed by manipulation of the slider. Finally, the filled bag is removed from the stack by tearing the bag away from the wicket flap, thereby severing the filled bag from the flap remnant that remains mounted to the wicket. Alternatively, the bags can be sealed to each other by ultrasonic pins during the process of forming holes for dispensing posts.

Figure 5:
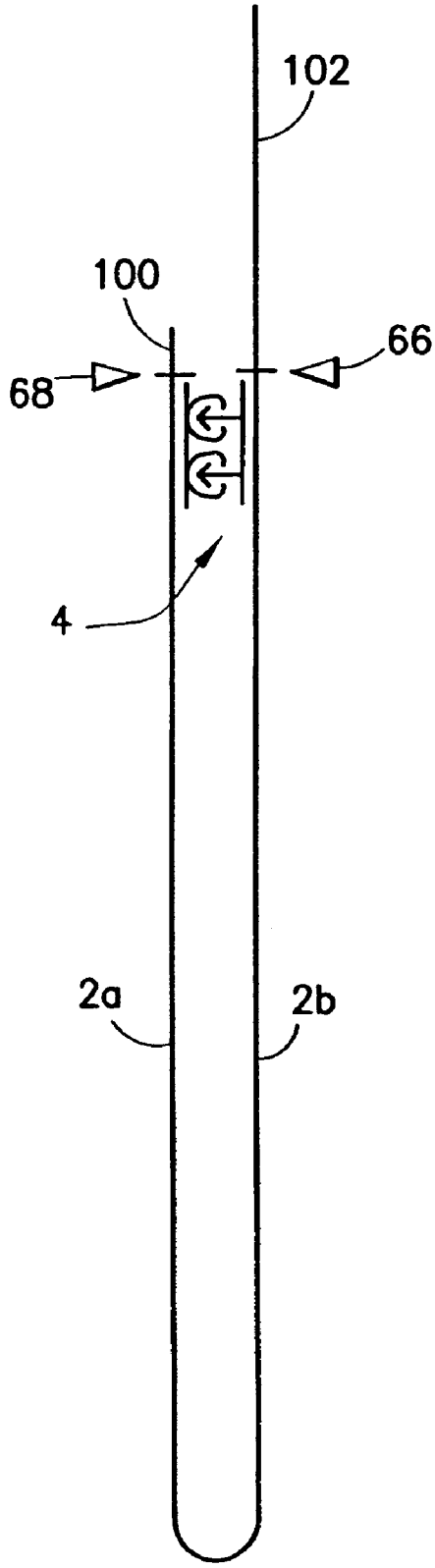
FIG. 5 is a drawing showing a sectional view of a string zipper joined to a folded web at an intermediate stage just prior to trimming) in the manufacturing process.

In the embodiment depicted in FIG. 1, both the receptacle 2 and the flap 8 are formed from a single web of bag making film of uniform thickness that is folded, cut and then joined. Initially, the bag making film is unwound from a supply roll and folded by a conventional plow or folding board along a line that is off-center, leaving one side of the folded web longer than the other side (as generally depicted in FIG. 5). As a result, although the edges of the web are mutually parallel, one edge is further away from the fold line than the other edge is. A zipper is then sealed to both legs of the web in conventional fashion, one zipper strip being joined to a marginal portion near one edge of the web while the other zipper strip is joined to the confronting portion of the web. Typically, the edge of the web on the short side extends slightly beyond the zone of joinder between the web and the first zipper strip. This narrow strip may be trimmed off to prevent interference with the slider. This trimmed portion of the web is removed by conventional vacuum trim removal equipment and discarded. On the other side of the web, the portion of the longer leg that extends beyond the zone of joinder between the web and the second zipper strip forms a much wider strip, which is also trimmed off. However, the wider trimmed portion, rather then being discarded, continues to travel downstream in the bag making machine and is used later to make the wicket flaps on the reclosable bags after the sliders have been inserted. The wider trimmed strip or piece is diverted under, over or around the slider insertion device and positioned between the ultrasonic transducer of the welding device and the zipper. As described in more detail below, the wider trimmed strip is reattached to the zipper/web assembly using the ultrasonic welding device that forms slider end stops on the zipper.

Figure 2:
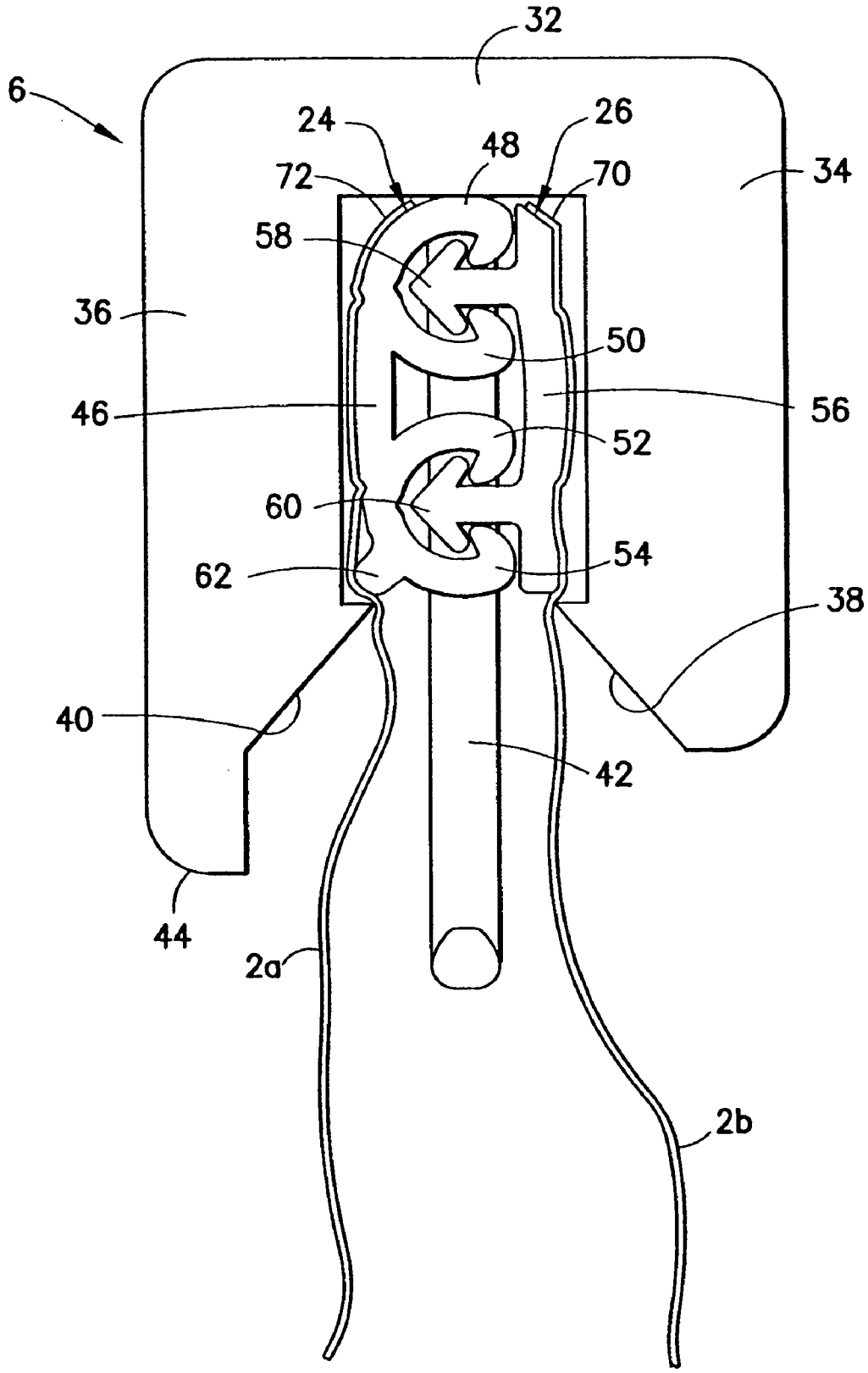
FIG. 2 is a drawing showing a fragmentary sectional view of one type of slider-string zipper assembly (previously disclosed in U.S. patent application Ser. No. 10/367,450 entitled "Reclosable Packaging Having Slider-Operated String Zipper") that may be incorporated in the bag depicted in FIG. 1. The zipper and bag film are shown sectioned in a plane in front of the closing end of the slider.

FIG. 2 shows a stage in the manufacture wherein the zipper has been attached to the web, but the web has not yet been trimmed by cutting along lines 74 and 76. As seen in FIG. 2, the string zipper is placed between opposing portions of the web with respective web portions extending beyond the zipper. The zipper is joined to the web of film by conventional conductive heat sealing using heated sealing bars 80 and 82 placed on opposing sides of the assembly. The sealing bars form band-shaped zones of joinder in central portions of the zipper strip backs. During this sealing operation, a portion of wall 2*a* is sealed to the back of the zipper strip 24, while a portion of wall 2*b* is sealed to the back of the zipper strip 26. Above the zone of joinder 3' with zipper strip 24, the web comprises a relatively narrow distal portion 100 that will be trimmed off by knife 68 and a free remnant portion 72 that remains after distal portion 100 has been removed. Alternatively, the edge of distal portion 100 may be sufficiently precisely aligned with the zipper strips 6, 8 so that no trimming is necessary. Conversely, above the zone of joinder 3 with zipper strip 26, the web comprises a relatively wide distal portion 102 that will be trimmed off by knife 66 and a free remnant portion 70 that remains after distal portion 102 has been removed. The full length of distal portion 102 is not shown in FIG. 2 due to the limited space available on this relatively large-scale drawing, but is shown in full in FIG. 3. In either case, the goal is to ensure that the web remnants adjacent the zipper-web seals do not interfere with slider travel or become entangled with the interlocking zipper profiles.

Figure 4:
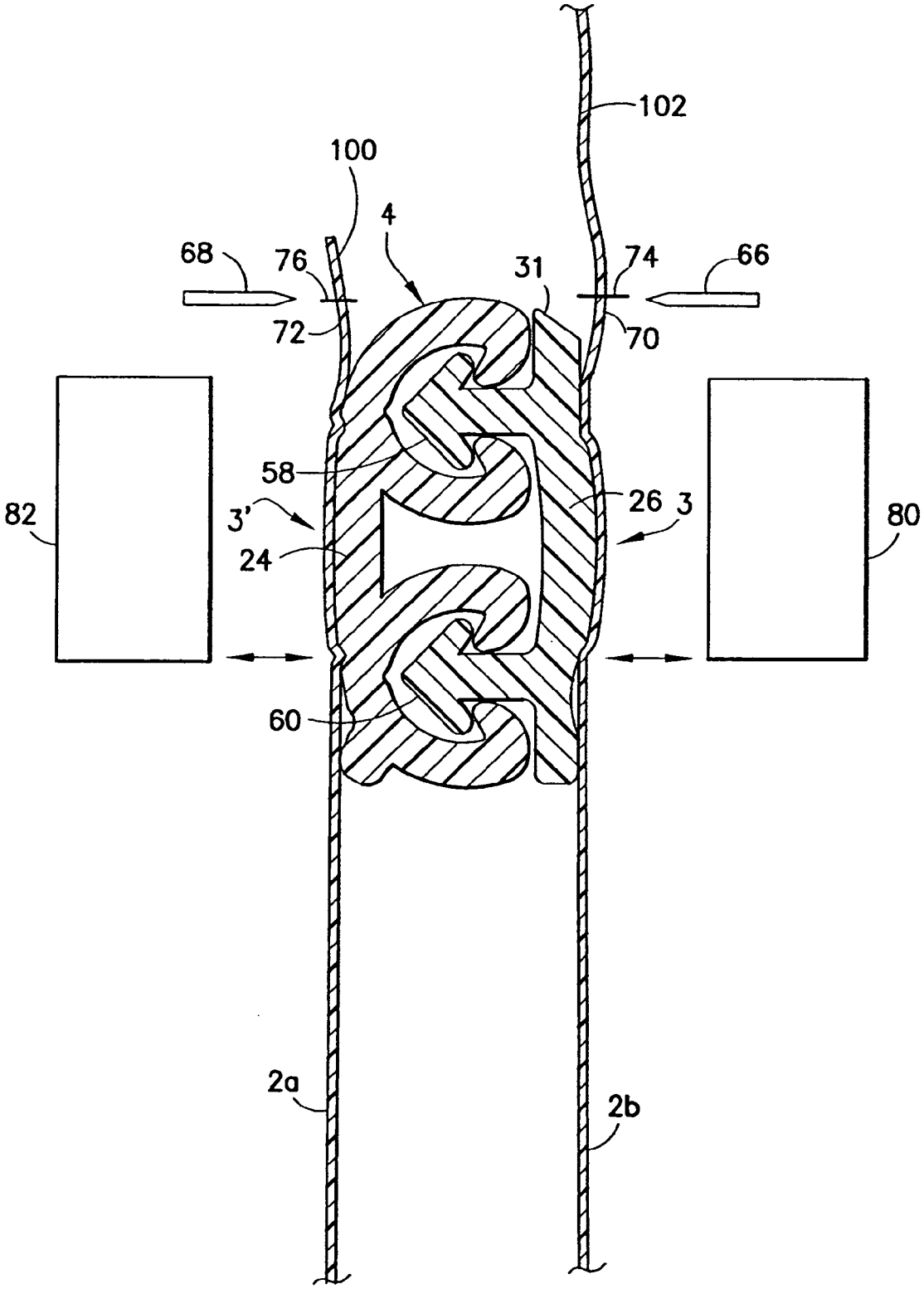
FIG. 4 is a drawing showing a fragmentary sectional view of a string zipper-film assembly during zipper sealing (and prior to trimming) in accordance with one method of manufacture.

After sealing the zipper to the walls of the web and then trimming the portions along the web edges, as depicted in FIG. 2, optionally the remnant portions 70 and 72 may be respectively sealed to the respective zipper strips by a specially designed heated sealing bar that is fully disclosed in U.S. patent application Ser. No. 10/655,991 entitled "Method and Apparatus for Making Reclosable Bags Having Slider-Actuated String Zippers". FIG. 4 shows a stage in the manufacturing process wherein the remnant portions 70 and 72 have been sealed to the tops of the respective zipper strips and the slider has been inserted onto the zipper. The operation whereby the free remnants are sealed to the zipper will be referred to herein as "lip sealing".

FIG. 4 shows the structure of one type of slider-zipper assembly that may be incorporated into the bag shown in FIG. 1. FIG. 4 shows the assembly at a stage in the manufacturing process after the slider has been inserted and before the wicket flap is attached to the ends of the zipper. The string zipper comprises a pair of zipper strips 24 and 26 having complementary profiles. The zipper strips 24 and 26 are formed by extruding a plastic material. The preferred material is polyethylene or polypropylene. The zipper strip 26 comprises a base 56 and two generally arrow-shaped rib-like male closure elements or members 58 and 60 projecting from base 56, while zipper strip 24 comprises two pairs of hook-shaped gripper jaws 48, 50 and 52, 54 connected by a sealing bridge or base 46. The pairs of gripper jaws 48, 50 and 52, 54 form respective complementary female profiles for receiving the male profiles of closure elements 58 and 60. The sealing bridge 46 and the base 56 are resiliently flexible self-supporting structures having a thickness greater than the thickness of the bag film. The male closure elements are integrally formed with the base 56, while the female closure elements are integrally formed with the sealing bridge 46. To open the closed zipper, the zipper strips 24 and 26 are pushed apart with sufficient force by a plow 42 of the slider to pry the heads of the male members out of the female profiles. When the shoulders of the male members clear the hooks of the outwardly flexed gripper jaws, the male and female members are no longer interlocked and the zipper is open.

The end face of upper edge 31 of the base 56 that carries the male closure elements 58 and 60 is inclined at about a 45° angle to facilitate loading of the slider onto the zipper from above without snagging on a corner of the upper edge. The bottom edge of the base 56 cooperates with a retaining ledge on the slider (to be described later) to increase the slider pull-off resistance. For the same purpose, a rib 62 is formed on zipper strip 24, the rib 62 cooperating with a retaining ledge on the other side of the slider.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile. In addition, although FIGS. 2 and 4 show a double rib-and-groove arrangement, the profiles of the zipper strips may take any form. For example, either string zipper may comprise alternating hook-shaped closure elements.

Nor is the invention limited to having two female profiles on one zipper strip and two male profiles on the other zipper strip. In the first place, the string zipper could have one complementary set of male and female profiles, or it could have more than two complementary sets of male and female profiles. Furthermore, in the case of two complementary sets of male and female profiles, one zipper strip could have one male profile and one female profile, while the other zipper strip has one female profile and one male profile. Other variations should be apparent to persons skilled in the art of resealable packaging.

After the zipper has been joined to the film structure and the film has been trimmed, a slider is inserted on the zipper-film assembly as seen in FIG. 4. The slider 6 is generally shaped so that the body of the slider (exclusive of the plow) straddles the zipper profiles. The upper margin of wall 2*a* of the film web is joined to the back of the zipper strip 24 and thus passes through the interstices between zipper strip 24 and the confronting sidewall 36 of the slider. On the other side of the zipper, the upper margin of wall 2*b* of the film web is joined to the back of the zipper strip 26 and thus passes through the interstices between zipper strip 26 and the confronting sidewall 34 of the slider.

The slider 6 is shown in more detail in FIG. 5. The slider 6 comprises a top wall 32, a pair of sidewalls 34 and 36 connected to opposing sides of the top wall 32, the top wall 32 and sidewalls 34, 36 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by a pair of substantially planar, inclined interior surfaces (only one of which, designated by numeral 90, is visible in FIG. 5) that converge toward the closing window of the slider. The inclined surfaces funnel or squeeze the zipper strips toward each other, causing the zipper profiles to interlock, as the slider is moved in the closing direction. The sidewalls 34 and 36 are formed with concave curved indentations where the user may place the tips of an index finger and a thumb for gripping the slider. Alternatively, convexities (e.g., ribs) could be formed on the sides of the slider to facilitate grasping.

The slider 6 also comprises a plow or divider 42 that depends downward from a central portion of the top wall 32 to an elevation below the lowermost portions of each sidewall. The plow partitions the tunnel inside the slider and is disposed between opposing sections of the zipper strips that pass through the tunnel. The tip of the plow 42 is truncated and has rounded edges and flattened corners 43 at opposing ends for facilitating insertion of the plow between the zipper profiles without snagging. The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper strips 24 and 26 apart. The plow 42 divides the closing end of the slider tunnel into respective passages for the separated zipper strips to pass through.

As partly seen in FIG. 3, the slider 6 further comprises a retaining projection or ledge 84 that projects inward from the sidewall 34 and a retaining projection or ledge 86 that projects inward from the sidewall 36. The ledges 84 and 86 project toward each other, forming respective latches for latching the slider onto the zipper. The ledges 84 and 86 have substantially coplanar, generally horizontal upper surfaces on which the bottom edges of the zipper profiles can sit, thereby effectively latching the slider under the bottom edges of the zipper strips to increase slider pull-off resistance. For improved gripping, the upper surfaces of the retaining ledges may be angled upward toward the distal edge.

The ledges 84 and 86 further comprise respective inclined bottom surfaces 38 and 40 that extend downward and outward from the respective inner edges of the generally horizontal ledge surfaces. The inclined surfaces 38 and 40 are each substantially planar and are oriented to guide the respective zipper strips 24 and 26 into the slider tunnel during insertion of the slider onto the zipper. The sliders are typically inserted at spaced intervals onto a zipper-film assembly that is being intermittently advanced in a machine direction by automated slider insertion equipment.

The slider may be made in multiple parts and welded together or the parts may be constructed to be snapped together. The slider may also be of one-piece construction.

The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS. To reduce the cost of manufacture, the slider may be designed to reduce the amount of material used and to increase the speed with which such sliders can be injection molded. Suitable injection-molded slider designs are fully disclosed in U.S. patent application Ser. No. 10/412,438.

Figure 6:
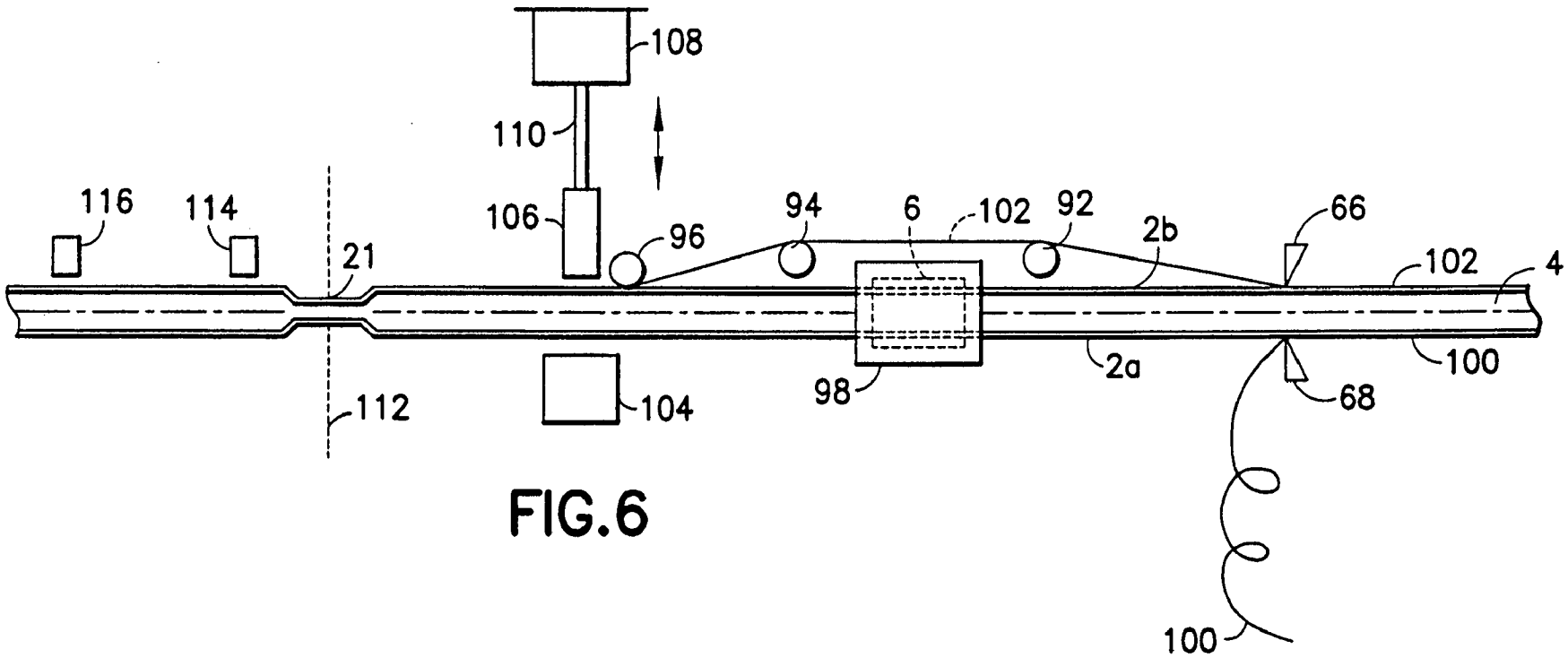
FIG. 6 is a drawing show a portion of a bag making machine in accordance with one embodiment of the invention.

Reclosable packages of the type depicted in FIG. 1 can be manufactured on an automatic production line. FIG. 6 shows various processing steps in accordance with one exemplary method of manufacture. Those steps include trimming the web; allowing the wider trimmed piece of film material to continue through the machine; inserting sliders on the zipper material; deforming the zipper material to form slider end stops while also tacking the wider trimmed piece to the slider end stops; and then punching wicket holes in the attached piece. The folded web is pulled through by conventional guide and drive rollers (not shown). Other steps in the automated manufacturing process are not shown. Conventional steps (not shown) that precede the steps shown in FIG. 6 include, but are not limited to, payout and folding of the web, payout and guidance of the zipper material, and sealing the zipper material to the folded web. Conventional steps (not shown) that follow the steps shown in FIG. 6 include, but are not limited to, cross sealing and cross cutting of the zipper-web assembly to form separate bags and then delivery of the finished bags to the pickup arms on the bag making machine. In addition, FIG. 6 does not show the previously mentioned lip sealing apparatus, which is optional. If lip sealing were to be included, the lip sealing apparatus would be installed between the web-trimming knives and the slider insertion device.

FIG. 6 shows a section of the production line in which the zipper-web assembly is advanced intermittently. However, a person skilled in the art will readily appreciate that the knives 66 and 68, which trim the web, could be located in a section of the bag making machine in which the web advances continuously. Typically, the zipper sealing station is located in the continuous advancement section. The continuous movement in that section would be converted to intermittent movement by a conventional dancer assembly (not shown). Alternatively, the zipper sealing operation could also be located in the intermittent advancement section of the bag making machine. The web of film material is preferably paid out from the supply roll continuously and folded by the folding board during continuous web advancement.

In the exemplary apparatus depicted in FIG. 6, all operations are performed during dwell times between successive advancements of the zipper-web assembly. These operations include cutting the web portions that extend beyond the zipper-web seals (i.e., also referred to herein as "zones of joinder"); inserting sliders onto the zipper material at spaced intervals therealong; ultrasonically stomping the zipper material at spaced intervals therealong to form slider end stops; and then punching a pair of holes in a strip of trimmed web material that is attached to the zipper during the ultrasonic stomping operation.

In FIG. 6, the film material and the zipper are seen from the side. Upstream of the knives 66 and 68 (i.e., to the right in FIG. 6), the portions of the film material that are visible are the portions 100 and 102 to be trimmed. At this juncture, the web and zipper have already been joined together, e.g., using conventional heated sealing bars to heat seal the web walls to the backs of the zipper strips. The cutting lines of the knives 66 and 68 should be located close enough to the respective zipper strips that the remnants of film projecting beyond the zipper are not long enough to interfere with operation of the slider as it moves along the zipper.

Downstream of the knives 66 and 68 (i.e., to the left in FIG. 6), the portions of the film material that are visible are the walls 2*a* and 2*b*, which are joined to the zipper 4. The relatively narrow strip 100 of trimmed film material is removed at knife 68 by conventional vacuum trim removal equipment (not shown) and discarded. The relatively wide strip 102 of trimmed film material is diverted after knife 66 and allowed to pass through a system of guide rollers. Although the guide rollers may be arranged in various configurations, FIG. 6 shows a simplified system wherein guide rollers 92 and 94 divert the strip 102 around the slider insertion zone and guide roller 96 guides the strip 102 along a pathway leading through an ultrasonic welding apparatus. The slider insertion zone is the space, traversed by the zipper, into which the slider insertion device 98 pushes the next slider 6 (represented by a dashed rectangle) to be inserted. In this example, the strip 102 is diverted above the slider insertion zone, but the machine could be redesigned so that the strip 102 is diverted under the slider insertion zone. Separate tension control means must be provided for the strip and the web.

FIG. 6 shows a slider 6 being inserted onto the zipper-film assembly by a slider insertion device 98. A respective slider will be inserted onto the zipper-film assembly after each advancement of the film. Although the structure of the slider insertion device is not shown in detail, the slider insertion device may be of the type comprising a pusher that pushes a slider onto an open section of the zipper in a slider insertion zone. The pusher displacement is driven by an air cylinder. The pusher is fixed to a distal end of a rod of a piston slidable inside the air cylinder. The pusher is alternately extended and retracted by actuation of the air cylinder, which has two separate ports for intake of compressed air from separately controlled air lines. A succession of sliders are fed periodically along a track by a conventional pneumatic slider feeding system. When the pusher is retracted, the next slider is fed automatically to a pre-insertion position directly in front of the pusher. When the pusher is extended, the next slider is pushed onto the zipper material.

During the same dwell time that a slider is being inserted, a slider end stop structure is being formed on the zipper material at an ultrasonic stomping station downstream from the slider insertion zone. The stomping station comprises a horn 106 and an anvil 104. In the disclosed embodiment, the horn is fixed to a distal end of a rod 110 of a piston slidable inside another air cylinder 108. The horn 106 is alternately extended and retracted by actuation of that air cylinder 108. However, the horn and anvil may be of the reciprocating or rotary variety.

In the extended position, the face of the horn 106 presses confronting portions of the strip 102 and zipper 4 against the anvil 104. In this compressed state, the horn is then activated to transmit ultrasonic wave energy into the thermoplastic material of the strip and zipper, causing the strip and zipper (with intervening layer of web wall 2*b*) to fuse together. This forms a zone of attachment for the film strip 102. One such zone of attachment will be made per package-length section of the zipper material. At the same time, the horn and/or anvil are designed to deform the zipper material during stomping into the desired slider end stop structure. This slider end stop structure will be bisected later when the film and zipper are cut in the cross direction using a hot knife (not shown) that both severs and seals the film. To the extent that the strip 102 extends below the slider end stop structure, the hot knife will cut both the strip and the web as well as seal their edges together. The cut (indicated by dashed line 112 in FIG. 6) forms two slider end stops, i.e., the end stop at the zipper fully closed slider park position for one package and the end stop at the zipper fully open slider park position for the next package.

Before the web, strip and zipper are cross-cut with a hot knife to form the package depicted in FIG. 1, a pair of wicket holes are punched in the attached strip 102 by respective hole punches 114 and 116 (see FIG. 6). Each bag is then delivered to the pick-up arms (not shown) on the bag-making machine. The bag is placed so that the holes 28 and 30 (see FIG. 1) in the wicket flap 8 align with and are penetrated by a pair of posts. Each successive bag takes its place atop the stack of bags mounted to the posts until a predetermined maximum number of bags is achieved. Then the stack is removed from the posts and a wicket is inserted into the aligned holes, these steps being typically performed either manually or automatically. A stack of wicketed slider bags can be used to package produce, deli meats, or other products.

A reclosable bag having the structure depicted in FIG. 1 can be manufactured using methods other than those described with reference to FIG. 6. For example, instead of folding the web of film and then inserting and joining string zipper material between opposing web portions, one side of the string zipper material could be joined to the film, the film is then folded, and thereafter the other side of the string zipper is joined to a confronting portion of the folded web. Alternatively, respective flangeless zipper strips could be joined in parallel to an unfolded web, the web is then folded along a centerline, and the zipper strips are interlocked after folding. Instead of starting with a single web that is folded, one could begin with two webs, only one of which is folded to form the flap at the tops of the bags. The opposing bottoms of the two webs could be sealed together to form the bottoms of the bags. The use of two webs would again entail the three variations of: (1) placing the string zipper between the webs and sealing the sides of the zipper to the respective webs; (2) sealing one side of the string zipper to one web, placing the other web in opposing relationship, and then sealing the other side of the string zipper to the other web; and (3) sealing one flangeless zipper strip to one web, sealing the other flangeless zipper strip to the other web, and then interlocking the zipper strips while attached to the respective webs.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable closure strips that have substantially no flange portions.

The invention claimed is:

1. A reclosable bag comprising a receptacle having a mouth, a string zipper joined to said receptacle at said mouth, said string zipper comprising first and second mutually interlockable zipper parts, a slider mounted to said string zipper to cause said first and second zipper parts to separate when said slider is moved in one direction along said string zipper and to cause said first and second zipper parts to interlock when said slider is moved in an opposite direction along said string zipper, and a header panel that is suspended between two zones of attachment generally located at opposite ends of said mouth, wherein said receptacle comprises first and second walls, said slider comprises first and second sidewalls, and each of said first and second zipper parts has a respective back, said first wall having a portion joined to said back of said first zipper part, said joined portion of said first wall being disposed between said back of said first zipper part and said first sidewall of said slider, and said second wall having a portion joined to said back of said second zipper part, said joined portion of said second wall being disposed between said back of said second zipper part and said second sidewall of said slider.

2. The bag as recited in claim 1, wherein respective portions of said first wall, said first zipper part and said header panel are joined together in said zones of attachment.

3. The bag as recited in claim 2, wherein said first and second zipper parts are fused together adjacent said zones of attachment.

4. The bag as recited in claim 1, wherein said header panel comprises first and second portions joined to said second wall, and a third portion not joined to said second wall, said third portion being disposed between said first and second portions and including a portion disposed adjacent said slider.

5. The bag as recited in claim 4, wherein said first portion of said header panel is disposed near a first corner of said header panel, said second portion of said header panel is disposed near a second corner of said header panel, and said third portion of said header panel comprises a marginal portion adjacent a free edge of said header panel, said marginal portion connecting said first and second corners of said header panel.

6. The bag as recited in claim 4, wherein said first and second zipper parts are fused together at first and second ends of said string zipper in shapes that form first and second slider end stops respectively, said first portion of said header panel being disposed adjacent said first slider end stop, and said second portion of said header panel being disposed adjacent said second slider end stop.

7. The bag as recited in claim 6, wherein said free edge provides clearance for said slider during transit of said slider between said first and second slider end stops.

8. The bag as recited in claim 1, wherein said header panel has a length equal to the width of said receptacle.

9. The bag as recited in claim 1, wherein said header panel comprises first and second holes.

10. The bag as recited in claim 1, wherein said header panel comprises first and second slits.

11. A reclosable bag comprising:

a zipper comprising first and second zipper strips, said first zipper strip comprising a first base and a first closure profile projecting from said first base, and said second zipper strip comprising a second base and a second closure profile projecting from said second base and engageable with said first closure profile;

a receptacle comprising first and second walls, said first wall comprising a marginal portion joined to said first base of said first zipper strip, and said second wall comprising a marginal portion joined to said second base of said second zipper strip;

a slider mounted on said zipper and movable in opposite directions for opening and closing said zipper, said slider comprising first and second sidewalls; and a flap comprising first and second portions joined to different portions of said joined second wall and second base, and a third portion not joined to said joined second wall and second base, said third portion being disposed between said first and second portions and including a portion disposed adjacent said slider, wherein said marginal portion of said first wall is disposed between said base of said first zipper strip and said first sidewall of said slider, and said marginal portion of said second wall is disposed between said base of said second zipper strip and said second sidewall of said slider.

12. The bag as recited in claim 11, wherein said first portion of said flap is disposed near a first corner of said flap, said second portion of said flap is disposed near a second corner of said flap, and said third portion of said flap comprises a marginal portion adjacent a free edge of said flap, said marginal portion connecting said first and second corners of said flap.

13. The bag as recited in claim 11, wherein said first and second zipper strips are fused together at first and second ends of said zipper in shapes that form first and second slider end stops respectively, said first portion of said flap being disposed adjacent said first slider end stop, and said second portion of said flap being disposed adjacent said second slider end stop.

14. The bag as recited in claim 13, wherein said free edge provides clearance for said slider during transit of said slider between said first and second slider end stops.

15. The bag as recited in claim 11, wherein said flap comprises first and second holes.

16. The bag as recited in claim 11, wherein said flap comprises first and second slits.

17. A reclosable bag comprising a receptacle having a mouth, first and second zipper strips installed in said mouth, said first and second zipper strips being fused at opposing ends thereof to form first and second slider end stops and being mutually interlockable between said first and second slider end stops, a slider mounted to said first and second zipper strips and selectively movable between said first and second slider end stops to cause said first and second zipper strips to separate or interlock, and a header panel comprising a first portion attached to said first slider end stop, a second portion attached to said second slider end stop, and a free third portion extending between said attached first and second portions and disposed adjacent said first zipper strip, wherein said third portion of said header panel does not interfere with movement of said slider, wherein said receptacle comprises first and second walls, said slider comprises first and second sidewalls, and each of said first and second zipper strips has a respective back, said first wall having a portion joined to said back of said first zipper part, said joined portion of said first wall being disposed between said back of said first zipper strip and said first sidewall of said slider, and said second wall having a portion joined to said back of said second zipper strip, said joined portion of said second wall being disposed between said back of said second zipper strip and said second sidewall of said slider.

18. The bag as recited in claim 17, wherein said first portion of said header panel is disposed near a first corner of said header panel, said second portion of said header panel is disposed near a second corner of said header panel, and said third portion of said header panel comprises a marginal portion adjacent a free edge of said header panel, said marginal portion connecting said first and second corners of said header panel.

19. The bag as recited in claim 17, wherein said header panel comprises at least one opening or slit.

* * * * *